US011455919B2

(12) United States Patent
Houlihan et al.

(10) Patent No.: US 11,455,919 B2
(45) Date of Patent: Sep. 27, 2022

(54) GRAPHIC DISPLAY STAND

(71) Applicant: Brightformat, Inc., Grand Rapids, MI (US)

(72) Inventors: Peter M. Houlihan, Grand Rapids, MI (US); Joe Ohlenbusch, Grand Rapids, MI (US)

(73) Assignee: Brightformat, Inc., Grand Rapids, MI (US)

( * ) Notice: Subject to any disclaimer, the term of this patent is extended or adjusted under 35 U.S.C. 154(b) by 121 days.

(21) Appl. No.: 17/177,514

(22) Filed: Feb. 17, 2021

(65) Prior Publication Data

US 2021/0256885 A1 Aug. 19, 2021

Related U.S. Application Data

(60) Provisional application No. 62/978,450, filed on Feb. 19, 2020.

(51) Int. Cl.

| | |
|---|---|
| ***A47G 1/16*** | (2006.01) |
| ***G09F 15/00*** | (2006.01) |
| ***A47G 1/17*** | (2006.01) |

(52) U.S. Cl.

CPC ..... *G09F 15/0056* (2013.01); *A47G 1/17* (2013.01)

(58) Field of Classification Search

CPC ..... F16M 11/22; F16M 11/38; F16M 11/40; F16M 13/02; A47B 97/04; G09F 15/0056; G09F 15/0062; G09F 2007/1856; G09F 7/18; A47G 1/14

See application file for complete search history.

(56) References Cited

U.S. PATENT DOCUMENTS

| | | | | | |
|---|---|---|---|---|---|
| 2,224,586 | A * | 12/1940 | Abbott | G09F 1/14 | 40/745 |
| D143,389 | S * | 1/1946 | Barbieri | D6/314 | |
| 3,525,493 | A * | 8/1970 | Newell | F16B 5/0614 | 40/658 |
| 4,827,639 | A * | 5/1989 | Wang | A47G 1/142 | 40/611.11 |
| D335,394 | S * | 5/1993 | Chamlian | D6/310 | |
| 5,664,749 | A * | 9/1997 | Kump | G09F 15/0012 | 248/225.11 |
| 8,302,339 | B2 * | 11/2012 | Pender | G09F 23/00 | 211/24 |
| 9,681,762 | B2 * | 6/2017 | Peng | A47G 1/065 | |

* cited by examiner

*Primary Examiner* — Cassandra Davis

(74) *Attorney, Agent, or Firm* — Warner Norcross + Judd LLP

(57) ABSTRACT

A graphic display system includes a stand for supporting a display panel in a freestanding, upright position. The stand includes a ground engaging bottom surface, and a sidewall extending upwardly from the ground engaging surface. The sidewall includes a front surface, a rear surface opposite the front surface, and a thickness defined between the front and rear surfaces. The front surface of the sidewall defines a central channel extending perpendicular to the ground engaging surface, and a channel retention element is positioned within the central channel, such that the central channel and the channel retention element cooperate to receive and retain the display panel to hold the display panel in the upright position. The channel retention element may include a spring, an adhesive, or a combination thereof.

19 Claims, 8 Drawing Sheets

GRAPHIC DISPLAY STAND

BACKGROUND OF THE INVENTION

The present invention relates to upright signs and graphic display panels, and more particularly to a stand for simple, efficient and cost effective set up and take down of such panels.

Upright graphic display panels are well known for displaying a variety of content and messaging. For example, a trade show exhibit may utilize one or more upright display panels for displaying content related to the particular goods and services of the exhibitor. These display panels generally include a flat, lightweight, but structurally rigid panel that is supported in an upright position by leaning on or attaching to a wall, or by supporting the panel on a ground surface by one or more stands. The display panel is provided with graphics and information on the front and rear surfaces related to the goods and services of the exhibitor.

Due to the fact that the trade show exhibits (and many other uses of upright display panels) are temporary, and that exhibitors generally have limited time to install and remove their exhibits, it is important for the means of installing and supporting the upright panels to be simple, lightweight, and effective. Propping or attaching to a wall can be unreliable because existing walls may be unavailable or not properly oriented. And conventional stands made of metal or wood for supporting display panels in a freestanding manner can be heavy, bulky and expensive. Accordingly, a need exists for an upright display panel system with a base or stand that can support the display panel in a freestanding manner, wherein the stand is easily manufactured and assembled, and is lightweight, simple and efficient to install and take down.

SUMMARY OF THE INVENTION

The present invention provides a graphic display system with a stand for supporting a display panel in a freestanding, upright position. In one embodiment, the stand includes a ground engaging bottom surface, and a sidewall extending upwardly from the ground engaging surface. The sidewall includes a front surface, a rear surface opposite the front surface, and a thickness defined between the front and rear surfaces. The front surface of the sidewall defines a central channel extending perpendicular to the ground engaging surface, and a channel retention element is positioned within the central channel, such that the central channel and the channel retention element cooperate to receive and retain the display panel to hold the display panel in the upright position.

In one embodiment, the sidewall of the stand includes first, second, third and fourth connected portions, and each of the sidewall portions has an inner surface, wherein the inner surface of the first portion abuts the inner surface of the third portion, and the inner surface of the second portion abuts the inner surface of the fourth portion. The stand may include at least one first fold channel between the first and third sidewall portions, and at least one second fold channel between the second and fourth portions, with the first and third sidewall portions folded together about the at least one first fold channel and the second and fourth sidewall portions folded together about the at least one second fold channel. The at least one first fold channel and the at least one second fold channel may each include a pair of spaced apart, parallel, V-shaped channels enabling the respective portions to be folded onto each other with their respective inner surfaces flush against one another.

In one embodiment, the first, second, third and fourth sidewall portions are each triangular shaped structural foam elements, the first and third portions being coterminous when folded together with inner surfaces abutting, the second and fourth portions being coterminous when folded together with inner surfaces abutting.

The channel retention element may include a spring, an adhesive, or a combination thereof. In one embodiment, the channel retention element includes at least one adhesive strip disposed in the central channel for engaging the display panel and retaining the display panel in the central channel. In another embodiment, the sidewall defines a spring channel that extends into the sidewall, the spring channel extending through both the first and second lateral sides of the central channel, and the channel retention element is a spring extending into the spring channel and across the central channel. The spring may have a base, a pair of arms extending from the base, the arms each having an inner surface and an outer surface, and a pair of wings, each wing extending outwardly from the outer surface of one of the arms, the wings extending into the spring channel.

The present invention further includes a method for assembling a graphic display stand system. The method generally includes the steps of:

(1) providing a structural base having first, second, third and fourth triangular sections, each section connected to at least one other section, each section having an inner surface, at least one first V-shaped fold channel between the first and third sections, at least one second V-shaped fold channel between the second and fourth sections, a square central channel between the first and second sections;

(2) attaching a channel retention element into the central channel;

(3) applying an adhesive to at least one of the first and third inner surfaces, and to at least one of the second and fourth inner surfaces;

(4) folding the third section about the at least one first V-shaped fold channel such that the inner surfaces of the first and third sections abut;

(5) folding the fourth section about the at least one second V-shaped fold channel such that the inner surfaces of the second and fourth sections abut, the first, second, third and fourth sections collectively forming a ground engaging surface, the central channel extending perpendicular to the ground engaging surface;

(6) positioning the ground engaging surface on the ground;

(7) providing a graphic display panel having opposing lateral edges, a front surface and a rear surface; and (8) inserting one of the lateral edges into the central channel of the base, the channel retention element providing a force on the graphic display panel to retain the graphic display panel in the central channel.

In one embodiment, the step of providing the channel retention element includes applying a first strip of adhesive to a first surface within the central channel, and applying a second strip of adhesive to a second surface within the central channel. The first strip may be applied to the first and third sections of the base after the folding the third section about the at least one first V-shaped fold channel, and the second strip may be applied to the second and fourth sections of the base after folding the fourth section about the at least one second V-shaped fold channel.

Figure 1:
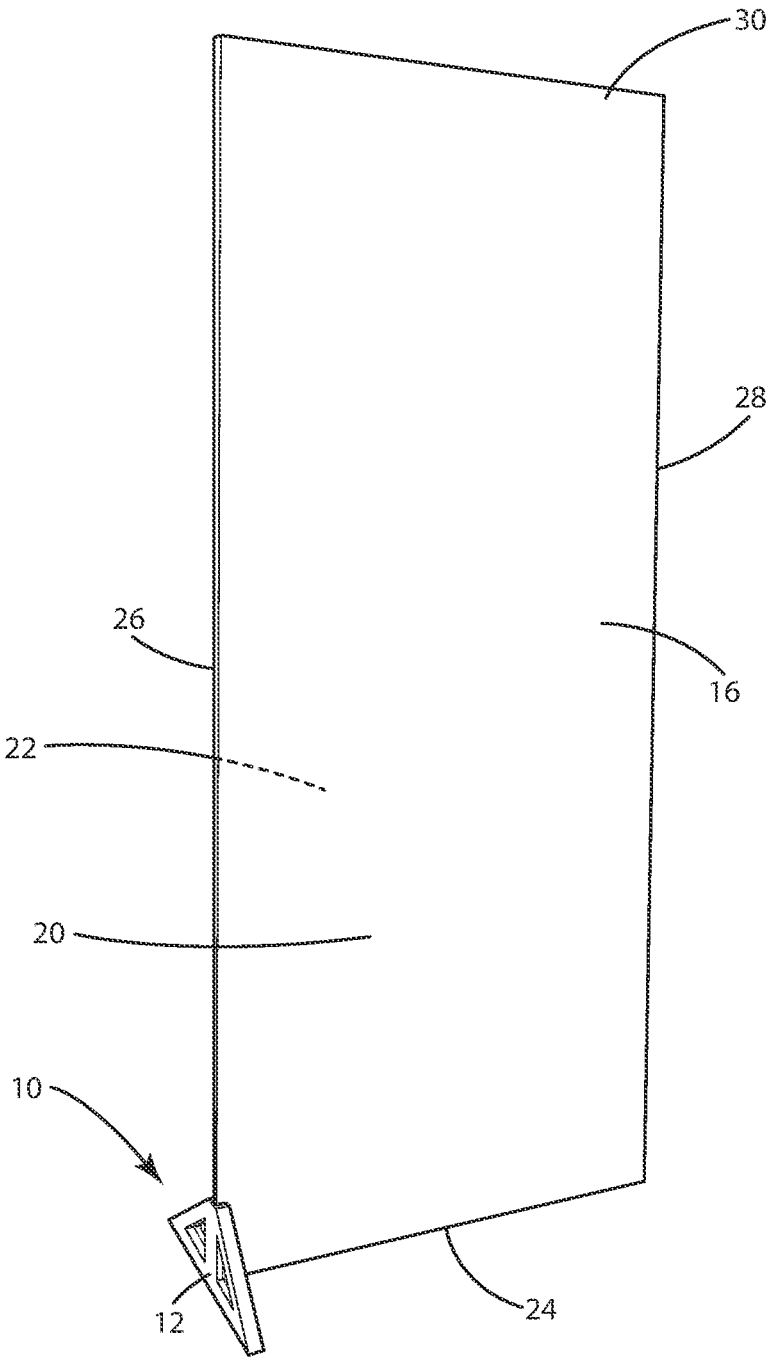
FIG. 1 is a view of a graphic display panel supported by a stand according to one embodiment of the present invention.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

The embodiments of the invention described herein relate to a stand for supporting an upright sign or graphic display panel. More particularly, the present invention provides a sturdy, lightweight, printable stand for supporting a variety of sizes of signs, such as those used in trade shows, without the need for separate tools or drilling.

I. Overview

According to one embodiment, the present invention is a display stand as shown in the Figures and generally designated 10. The stand 10 includes a base 12 and a channel retention element 13 that cooperate to support an upright sign or other graphic display panel 16. The base 12 may be a single piece that is constructed to be folded into the desired shape, and the channel retention element 13 may be a spring 14, 114 or an adhesive 214 positioned on the base 12 such that the folded base 12 and the channel retention element 13 cooperate to support and retain a lateral edge 26 of the display panel 16 to independently hold the display panel 16 in an upright position.

II. Structure

Figure 2:
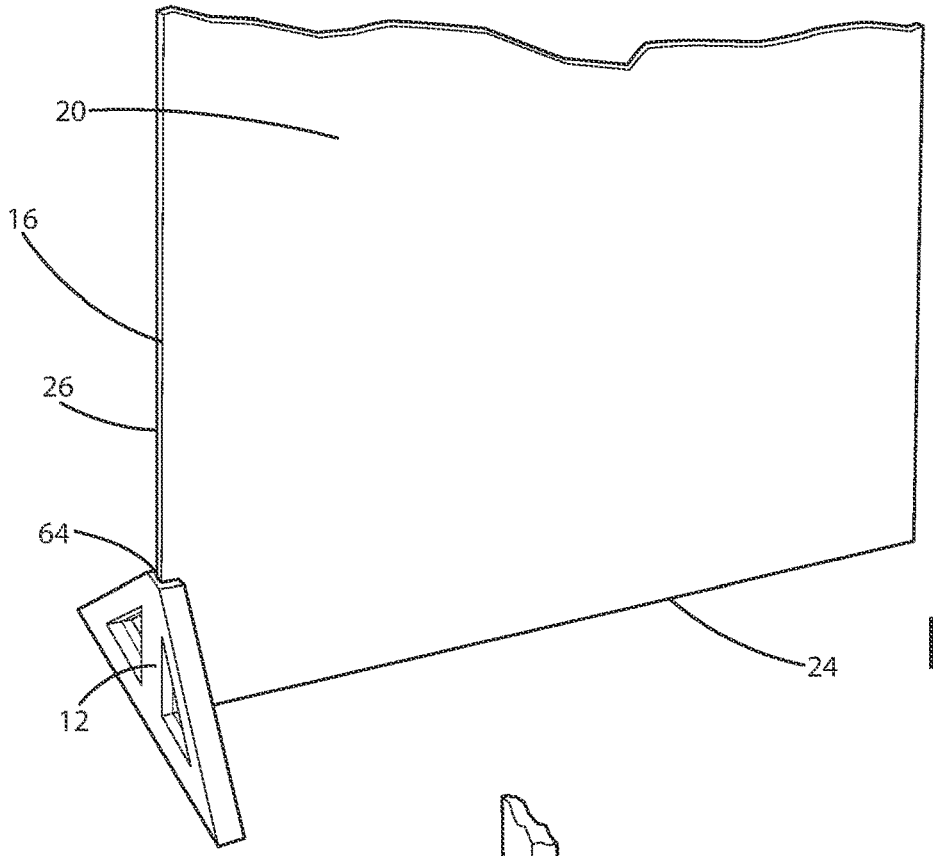
FIG. 2 is close up view thereof.
Figure 3:
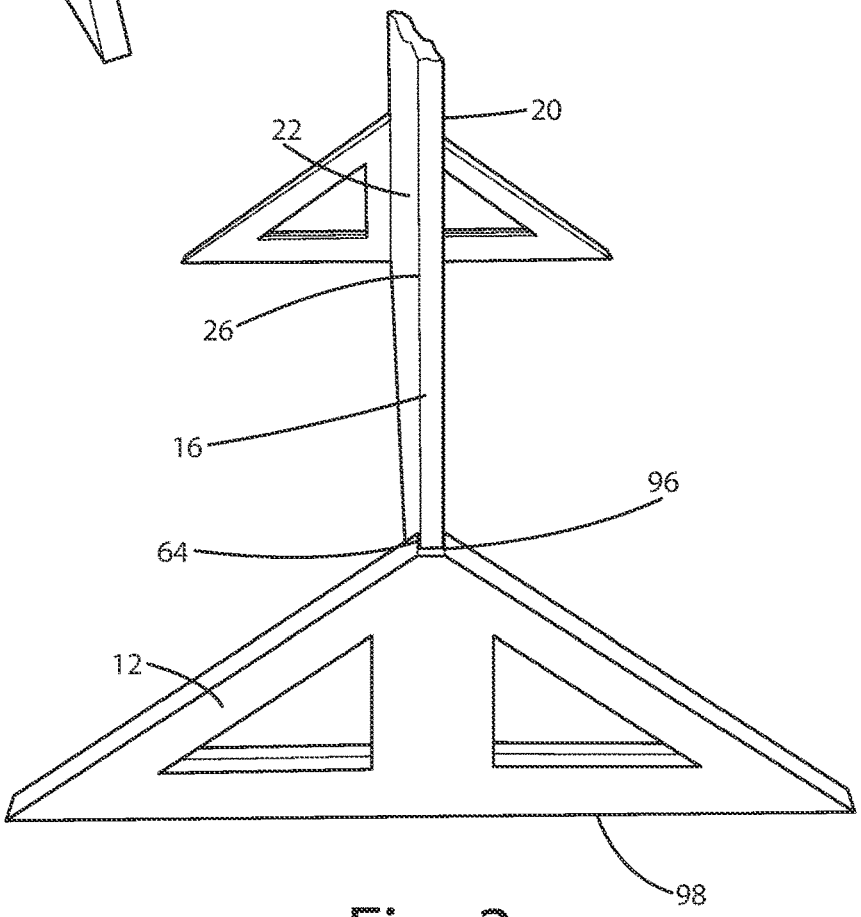
FIG. 3 is a side view thereof.

Referring to FIGS. 1-3, one or more stands 10 may be used to support a graphic display panel 16. FIGS. 1 and 2 show a single stand 10, and FIG. 3 shows a pair of stands 10. The display panel 16 may be made of a variety of materials and may have a variety of shapes and sizes, and the amount and placement of the stands 10 may be predetermined to adequately support the particular display panel 16 chosen. In one embodiment, the display panel 16 is a corrugated, structural panel having a front surface 20 and a rear surface 22 defining a thickness therebetween. In the illustrated embodiment, the display panel 16 includes a bottom edge 24, a pair of lateral side edges 26, 28, and a top edge 30. The display panel 16 is illustrated as a generally rectangular display, with the lateral sides 26, 28 longer than the top 30 and bottom 24. Although shown with a plain white front surface 20, all surfaces and sides of the display panel 16—and the base 12—may be printed with desired information such as images, text, logos, embossments and other visual materials. In another embodiment, the panel 16 may be formed from plastic, other paper or cardboard configurations, or other materials.

Figure 4:
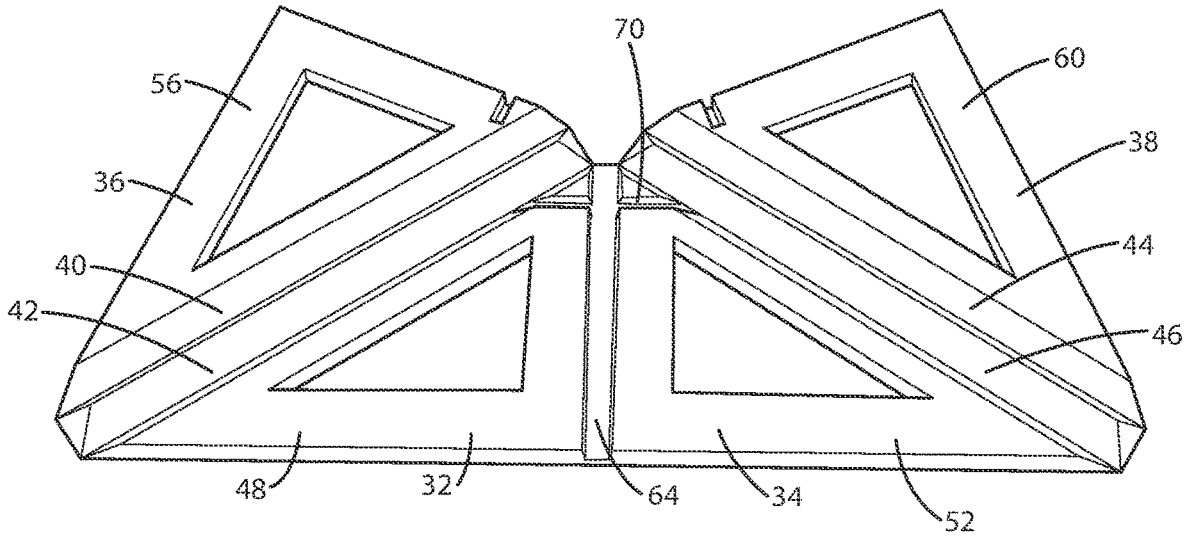
FIG. 4 is a front view of a graphic display base in an unfolded form according to the one embodiment.
Figure 5:
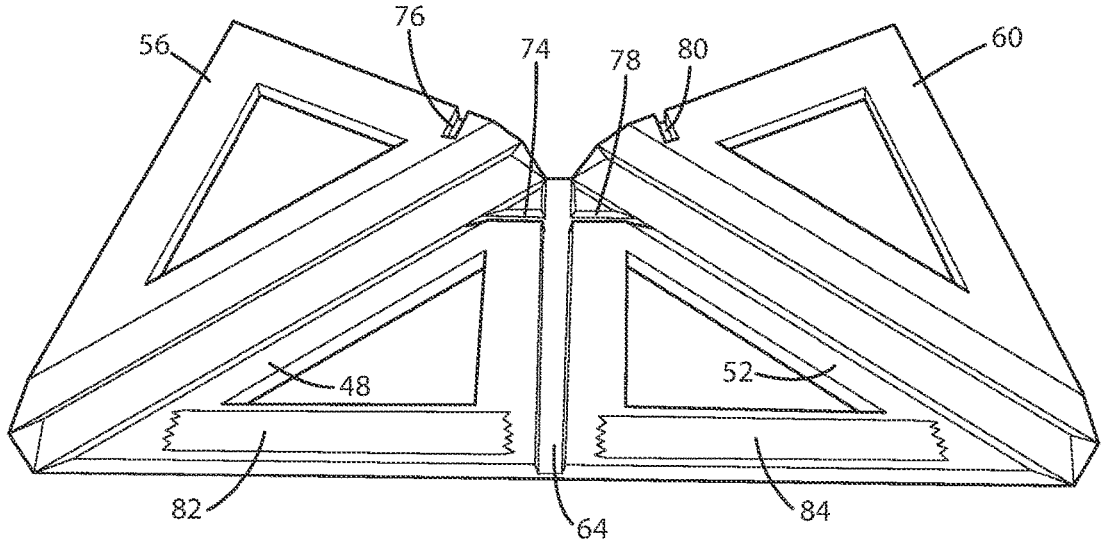
FIG. 5 is another view thereof.

As shown in FIGS. 4 and 5, the base 12 may be formed from a single piece of material that is configured to be folded into the shape of the stand 10. The base 12 may be formed from a variety of structural materials sufficient to support the desired panel 16, such as foam or a corrugated material. In the illustrated embodiment, the base 12 is formed from ½" foam and includes a series of V-shaped channels that create predetermined fold lines. The fold lines are selected such that the material can be folded about the fold lines during the assembly process and the folded product takes the desired shape of the stand 10. With reference to FIG. 4, the base includes first 32, second 34, third 36 and fourth 38 open triangular portions. V-shaped channels are provided between the first 32 and third 36 portions and between the second 34 and fourth 38 portions. More particularly, a first set of parallel V-shaped fold channels 40, 42 extends between the first 32 and third 36 portions, and a second set of parallel V-shaped fold channels 44, 46 extends between the second 34 and fourth 38 portions 44. The first triangular portion 32 has an inner surface 48. The second triangular portion 34 has an inner surface 52. The third triangular portion 36 has an inner surface 56, and the fourth triangular portion 38 has an inner surface 60. The first 32 and second 34 triangular portions are separated by a square central channel 64. In one embodiment, this central channel 64 has a width that is approximately the same as the thickness of the display panel 16 for supporting the display panel 16 within the channel 64.

As shown in FIGS. 4-8, the base 12 may define a space or channel 70 for retaining the lateral edge 26 of the display panel 16 and for incorporating the channel retention element 14. More particularly, with reference to FIG. 5, the base 12 defines first 74 and second 76 cooperating retention channels in the inner surface 48 of the first triangular portion 32 and in the inner surface 56 of the third triangular portion 36. The base 12 defines third 78 and fourth 80 cooperating retention channels in the inner surface 52 of the second triangular portion 34 and in the inner surface 60 of the fourth triangular portion 38. The first 74 and second 76 channels align when the first 32 and third 36 triangular portions are folded and the third 78 and fourth 80 channels align when the second 34 and fourth 38 triangular portions are folded. Optionally, one or more portions of the inner surfaces 48, 52, 56 and 60 may be provided with a base adhesive to assist in holding these surfaces together once folded. In the embodiment shown in FIG. 5, the base fold adhesive includes a first section of double-sided tape 82 is positioned on the inner surface 48 of the first triangular portion 32 and a second section of double-sided tape 84 is positioned on the inner surface 52 of the second triangular section 34, such that the respective inner surfaces 48 and 52, and the respective inner surface 52 and 56, adhere to one another when folded. Alternative locations and types of base fold adhesives may otherwise be used.

FIGS. 1-3 show the base 12 in a folded configuration. As noted, in the folded configuration, the base 12 is folded along the fold channels 40, 42 and 44, 46. When folded, the respective inner surfaces 48 and 52 of the first 32 and third 36 triangles meet and abut each other, and the respective inner surfaces 52 and 56 of the second 34 and fourth 38 triangles meet each other. In an embodiment including a base fold adhesive, the respective surfaces adhere to one another when folded. The resulting folded base 12 is triangular in shape, and includes a pointed upper end 96 and a flat, lower ground engaging surface 98. When the folded base 12 is placed upright with the ground surface 98 engaging the ground, the central channel 64 extends generally vertically.

Figure 6:
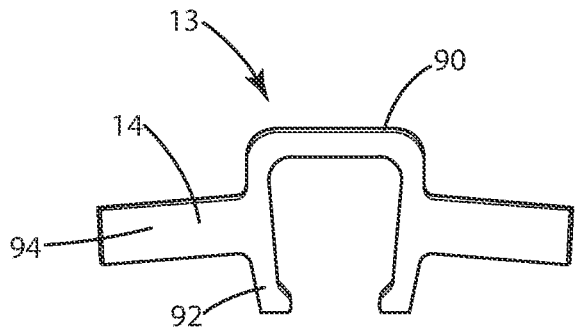
FIG. 6 is a view of a spring according to one embodiment.
Figure 7:
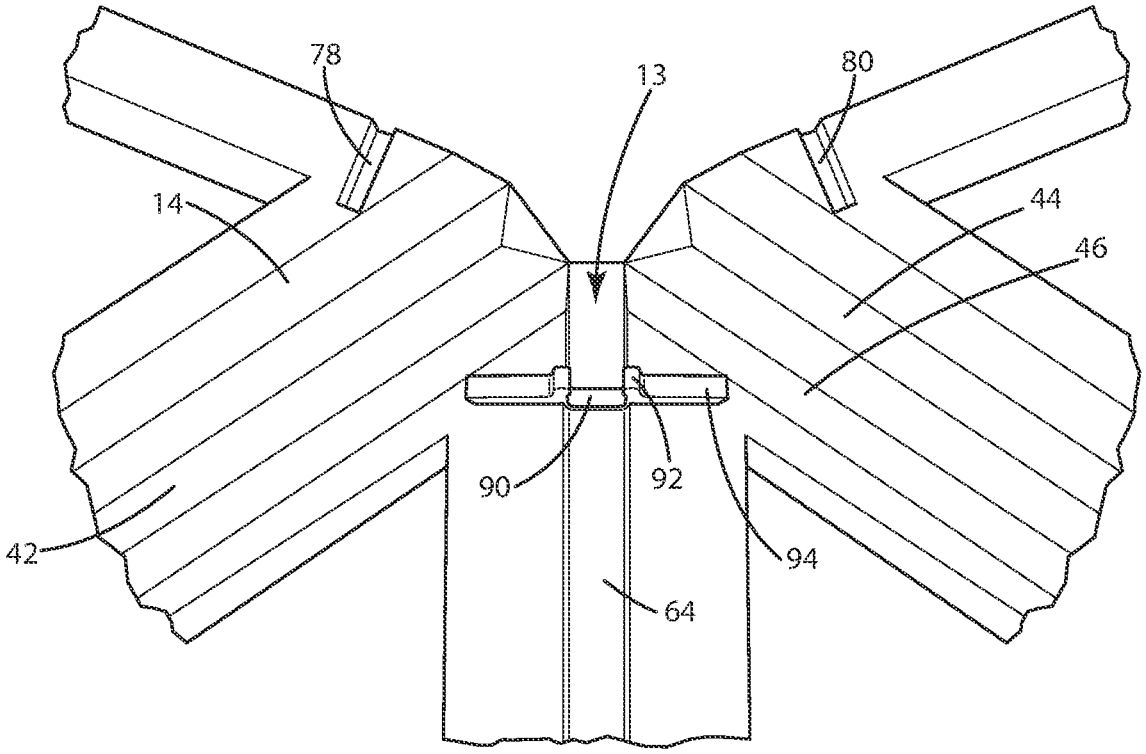
FIG. 7 is a close up view of the graphic display stand and spring.
Figure 8:
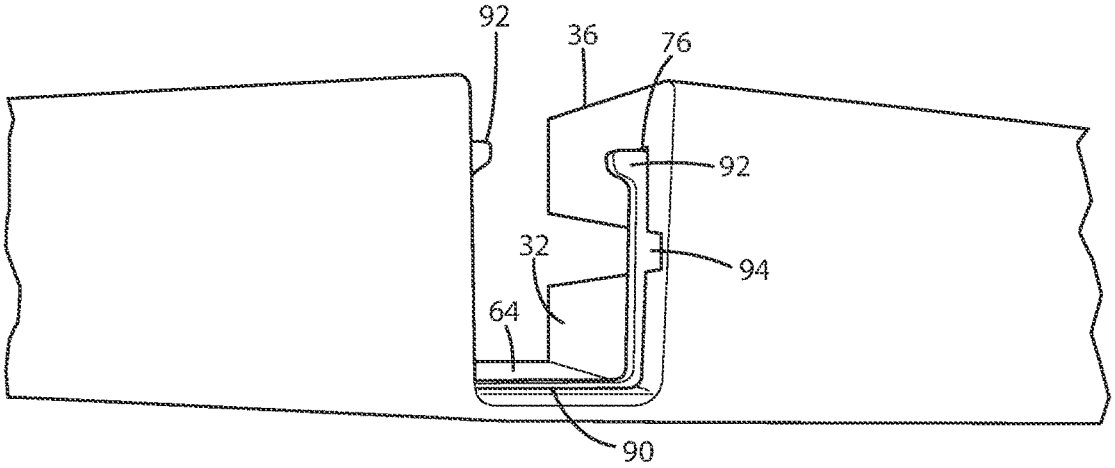
FIG. 8 is close up view of the assembled and folded graphic display stand and spring.

FIGS. 6-8 show one embodiment of a channel retention element 13, wherein the channel retention element 13 is a spring 14 for use with the stand 10. In this embodiment, the spring 14 is a molded plastic spring 14 having a base 90, a pair of spring arms 92 extending outwardly from the base 90, and a pair of wings 94 extending outwardly from the spring arms 92. The base 90 and the arms 92 collectively form a U-shaped recess for receiving and retaining an edge of the display panel 16. As a result, the base 90 generally defines a length that is approximately the same as, or slightly greater than, the thickness of the display panel 16. The arms 92 angle slightly towards each other as they extend away from the base 90, creating a degree of pretension in the arms 92 that can act to retain the display panel 16 between the arms 92. In the illustrated embodiment, the wings 94 extend outwardly from the arms 92 at approximately the midpoint of the arms. The wings 94 extend in opposite directions from one another.

FIGS. 7 and 8 more particularly show how the spring 14 fits within the base 12. FIG. 7 shows an unfolded base 12 with the spring 14 inserted. As shown, the wings 94 are inserted in to the first 74 and third 78 spring channels with the base 90 and arms inserted into the square channel 64 with the U-shaped recess opening outwardly. A portion of the wings 94 may protrude upwardly beyond the surface of the base 12. FIG. 8 shows a folded base 12 with the spring 14 retained within the base 12. The protruding portions of the wings extend into the second 76 and fourth 80 spring channels and are entrapped by the spring channels 76, 80, and the U-shaped recess remains open within the square channel 64 for receiving a portion of the display panel 16.

Figure 9:
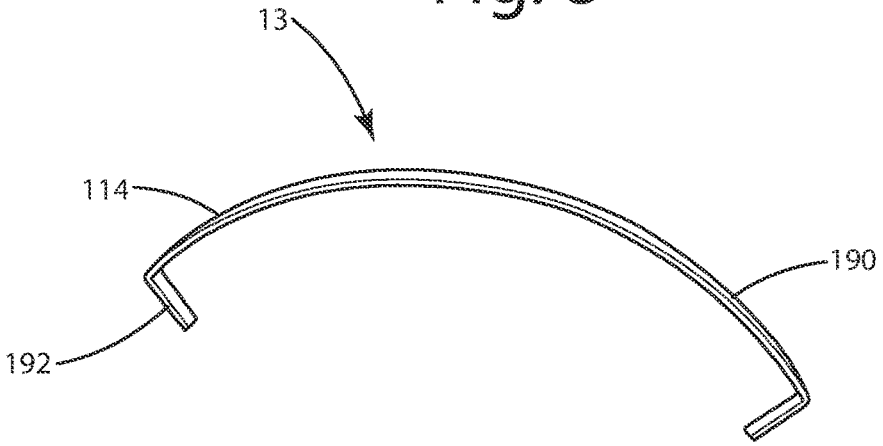
FIG. 9 is a side view of a spring according to an alternative embodiment.
Figure 10:
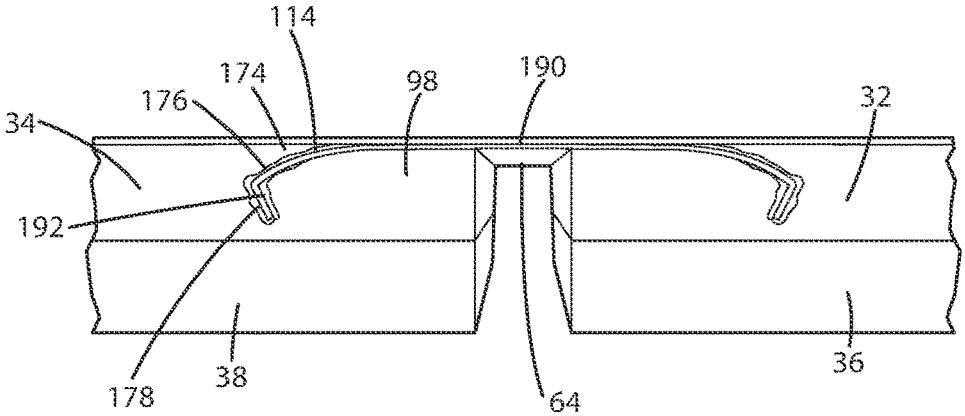
FIG. 10 is a side assembled view of the alternative spring.
Figure 11:
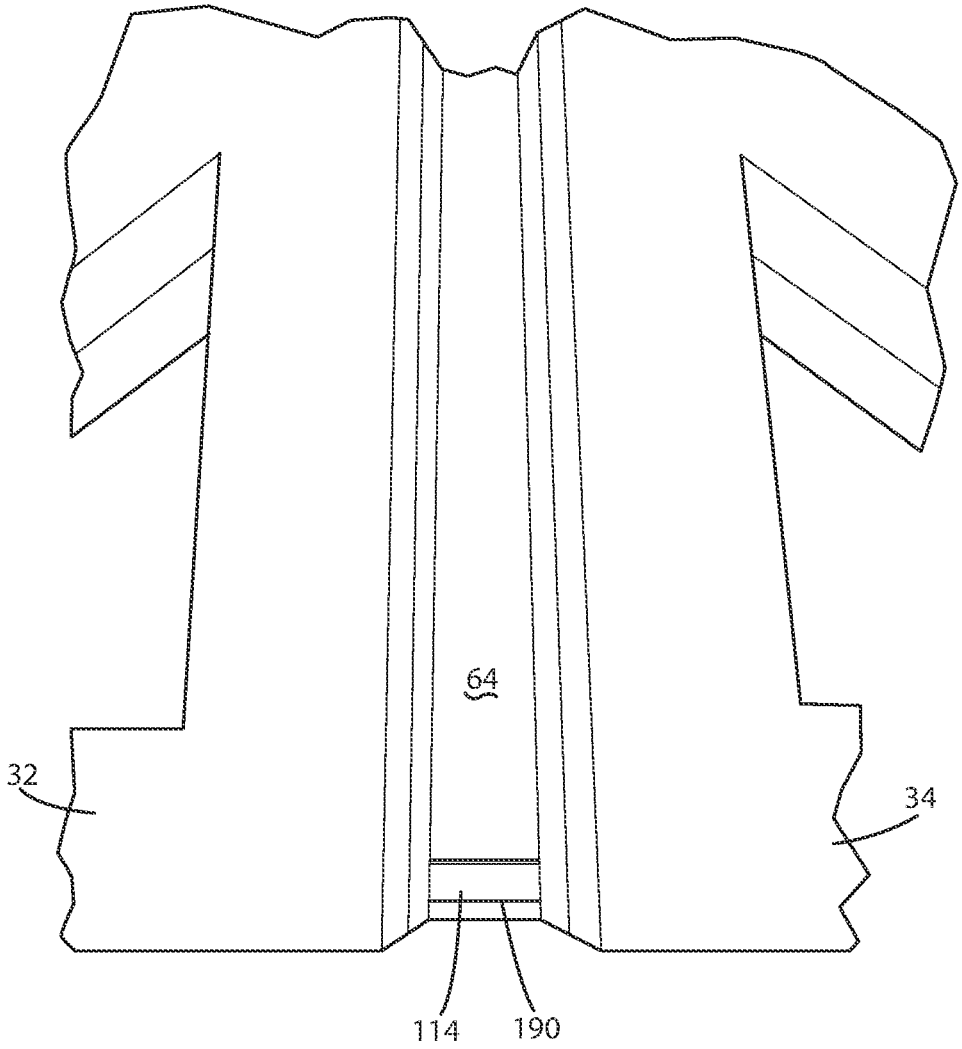
FIG. 11 is a top close up assembled view of the alternative spring.

FIGS. 9-11 show an alternative embodiment of a channel retention element 13, wherein the channel retention element 13 is a spring 114. In this embodiment, the spring 114 is formed from spring steel and includes a base 190 and a pair of spring arms 192 extending from the base 190. As illustrated, the base 190 has a concave shape. The spring arms 192 extend inwardly from the ends of the base 190. FIGS. 10 and 11 show the spring 114 installed within the folded base 12. In this embodiment, the spring 114 is inserted into a channel 174 that is formed into the bottom end 98 of the base 12, with a base channel portion 176 that extends through a portion of first triangle 32, the central channel 64, and a portion of second triangle 34. Arm channel portions 178 extend inwardly from the base channel portion 176 for insertion of the spring arms 192. In one embodiment, the base channel portion 176 is shaped such that the base 190 must be flexed open slightly for insertion into the channel portion 176. As a result, the spring 114 has a degree of pretension that acts to force the central channel 64 closed prior to insertion of the display panel 16 into the channel 64.

Figure 12:
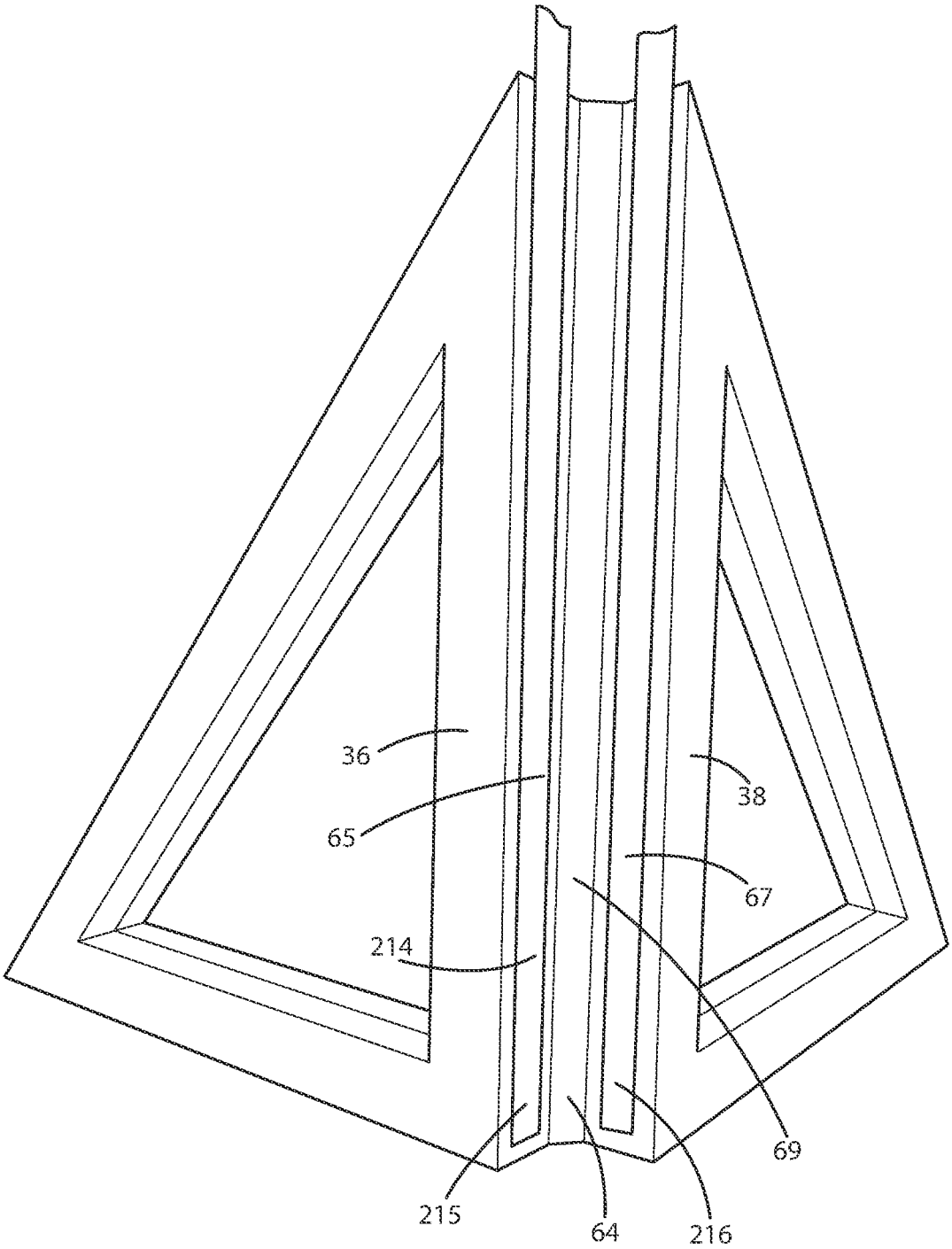
FIG. 12 is a view of a graphic display base in a folded form according to another embodiment with an adhesive channel retention element.
Figure 13:
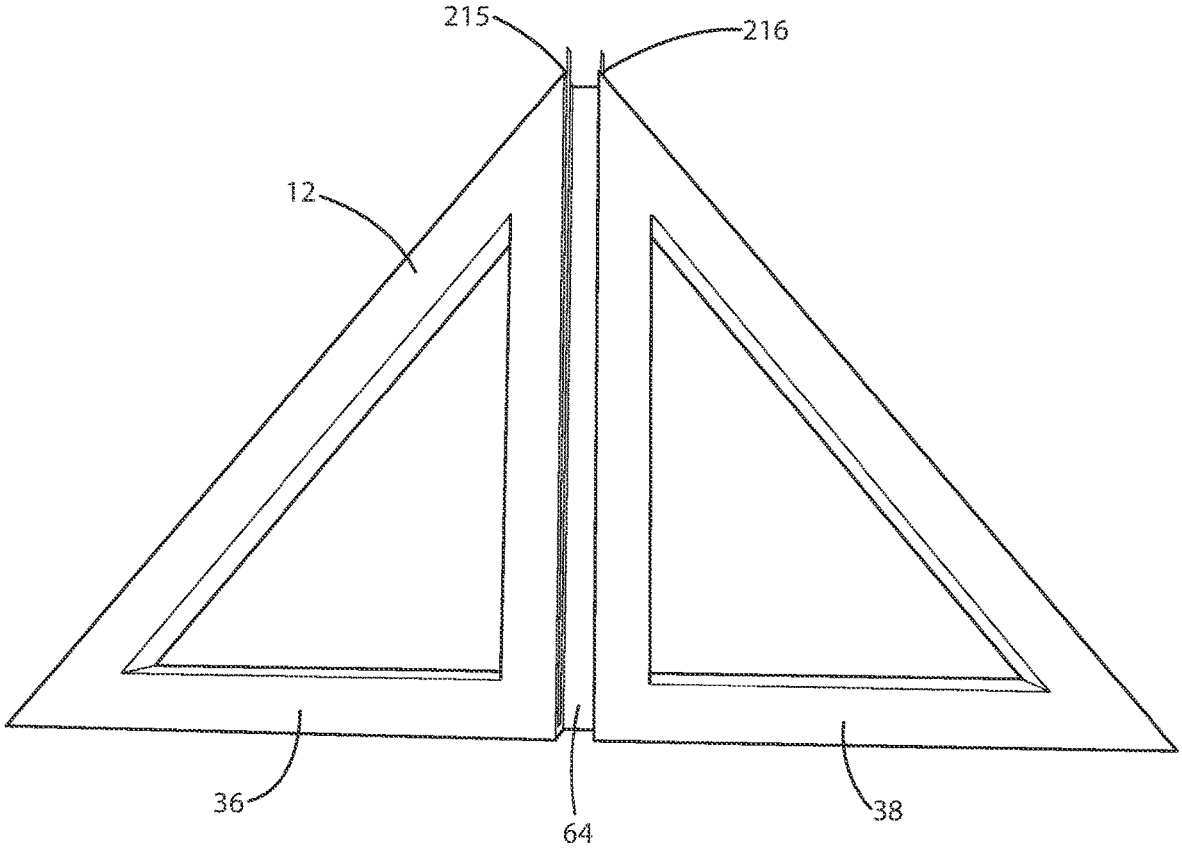
FIG. 13 is a top view thereof.

FIGS. 12-13 show another alternative embodiment of a channel retention element 13, wherein the spring is optionally replaced with an adhesive 214. More particularly, in the embodiment shown in FIGS. 12-13, the base 12 is shown in a folded configuration and has a combined thickness of the folded first 32 and third 36 triangular portions and the folded second 34 and fourth 38 folded portions, and the resulting central channel 64 also has the combined thickness of the folded portions with a first sidewall 65, a second sidewall 67 and a bottom wall 69. As illustrated, a first adhesive 214, in the form of a strip of double-sided adhesive tape 216 is disposed on the first sidewall 65, and a second strip of double-sided adhesive tape 218 is disposed on the second sidewall 67. As shown, each strip 215, 216 is a continuous strip extending the entire length of the channel 64. In another embodiment, the adhesive 214 may be disposed intermittently along the sidewalls 65 and 67 and optionally on the bottom wall 69 and may be provided in a different format such as one or more sections of glue. In embodiment illustrated in FIG. 12, the adhesive strips 215, 216 are applied after the base 12 has been folded, such that the strip 215 engages portions of both the first 32 and third 36 portions within the central channel 64 and the strip 216 engages portions of both the second 34 and fourth portions within the central channel 64. In another embodiment, the adhesive strips 215, 216 may be intermittent strips applied within the channel 64, and may alternatively or additionally be applied to the bottom wall 69 of the central channel 64.

III. Assembly

An assembled version of the stand 10 with a graphic display panel 16 inserted is shown in FIGS. 1-3. A desired display panel 16 is provided, which generally includes front and rear surfaces 20, 22 that have been printed to include a desired graphic content (notably, the panels in FIGS. 1-3 are blank and ready to be printed with desired content). The display panel 16 is supported by the stand 10.

Formation of the assembled stand 10 generally begins with formation of the base 12. As noted above, the base 12 can be formed from a variety of structural materials, and is formed by providing a base 12 of desired shape, and further by forming one or more channels into the base 12 for folding the base to a desired final form. In the illustrated embodiment, the formation of the base 12 includes forming the base 12 to include first 32, second 34, third 36 and fourth 38 triangular portions, and also forming V-shaped channels 40 and 42 between the first 32 and third 36 triangular portions and V-shaped channels 44, 46 between the second 34 and fourth 38 triangular portions. The central channel 64 is formed between the first 32 and second 34 triangular portions and is sized to receive the thickness of the display panel 16. In an embodiment including an adhesive such as the tape 82, 84, the adhesive is generally applied to the base 12 prior to the base 12 being folded.

A channel retention element 13, such as spring 14, or an alternative spring such as spring 114, or channel retention adhesive 214, may positioned on or within the base 12 for added retention strength. In the embodiment shown in FIGS. 4-8, the spring 14 is inserted into the base 12 with the wings 94 inserted into the spring channels 74 and 78, and the spring base 90 inserted into the central channel 64 with the spring arms 92 extending outwardly from the channel 64. In an embodiment with alternative spring 114, the spring 114 may be inserted into the spring channel 174 in the ground engaging end 98 of the base 12 by flexing the spring 114 to open it slightly and then inserting it into the channel 174.

Other spring configurations may otherwise be used for adding retention strength on the panel 16, and in one embodiment, a base 12 may include multiple springs 14, 114 spaced apart along a central channel 64. In the alternative embodiment shown in FIGS. 12 and 13, the channel retention element 13 includes strips of adhesive 215, 216 extending along the sidewalls 65, 67 of the channel 64. Although not shown, in one optional embodiment the adhesive 214 may be used in combination with spring 14 or 114.

In the illustrated embodiment, the base 12 is moved to the folded position prior to attachment of the display panel 16. The base 12 is generally moved to the folded position (as shown in FIGS. 1-3) by folding about V-shaped channels 40, 42 and 44, 46. When folded, inner surfaces 48 and 52 abut each other, and inner surfaces 52 and 56 abut each other. To the extent that the wings 94 protrude beyond the spring channels 74, 78, the protruding portions are received in spring channels 76, 80 to retain the spring within the folded base 12. Backing from the adhesive tape 82, 84 is removed prior to folding, and the exposed adhesive adheres the inner surface 48 to inner surface 52 and adheres the inner surface 52 to inner surface 56. As shown in FIG. 8, the resulting folded base 12 has a combined thickness of the folded first 32 and third 36 triangular portions and the folded second 34 and fourth 38 folded portions. The resulting central channel 64 is also the combined thickness of the folded portions. In the illustrated embodiment, this combined thickness is greater than the length of the spring arms 92, such that the spring arms do not extend beyond the thickness of the folded central channel 64. In the embodiment utilizing adhesive 214, the adhesive strips 215, 216 or other form of adhesive may be applied to the channel 64 before or after the base 12 has been folded.

One or more assembled bases 12 are used to support a display panel 16 in an upright position. As shown in FIG. 2, one of the lateral side edges 26 of the display panel 16 may be inserted into the central channel 64 of a base 12 and between the spring arms 92 with spring arms 92 extending over a portion of the front 20 and rear 22 surfaces of the display panel 16. An opposite one of the lateral side edges 28 may be inserted into the central channel 64 of a second base 12 in a similar manner, with the bottom surface 98 both bases 12 engaging the ground and the bottom edge 24 of the display panel 16 facing the ground. In the illustrated embodiment, the central channel 64 extends completely from the top edge 96 to the ground engaging edge 98 of the base 12, such that the bottom edge 24 of the display panel 16 can contact the ground. Alternatively, however, the central channel 64 may extend only a portion of the height of the base 12 to support the bottom edge 24 of the display panel 16 at a desired height from the ground. In the alternative embodiment with an adhesive 214 replacing the spring 14, 114, the base 12 may be folded to slightly open the channel 64 for insertion of the display panel 16 between the adhesive strips 215, 216, and the base 12 may then be moved to close the channel 64 such that the adhesive strips 215, 216 engage the front 20, and rear 22 surfaces to hold the base 12 securely in place on the panel 16.

In another embodiment, one or more stands 10 can be used in connection with display panels 16 and other displays in different configurations. For example, multiple panels 16 may be connected to one another via various connection means, and the one or more stands 10 can be arranged to support the multiple panels in an upright position. In yet another embodiment, the central channel 64 and spring 14, 114 may be oriented to open vertically, such that they are able to capture and support the lower end 24 of a display panel 16 rather than the lateral sides edges 26, 28.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A graphic display stand for supporting a display panel in an upright position, comprising:

a ground engaging bottom surface;

a sidewall extending upwardly from the ground engaging surface, the sidewall including a front surface, a rear surface opposite the front surface, and a thickness defined between the front and rear surfaces, the front surface of the sidewall defining a central channel extending perpendicular to the ground engaging surface, the central channel having a first lateral side and a second lateral side; and a channel retention element positioned within the central channel, the central channel and channel retention element cooperating to receive and retain a display panel to hold the display panel in an upright position;

wherein the sidewall defines a spring channel that extends into the sidewall, the spring channel extending through both the first and second lateral sides of the central channel, and wherein the channel retention element is a spring extending into the spring channel and across the central channel.

2. The graphic display stand of claim 1 wherein the spring has a base, a pair of arms extending from the base, the arms each having an inner surface and an outer surface, and a pair of wings, each wing extending outwardly from the outer surface of one of the arms, the wings extending into the spring channel.

3. The graphic display stand of claim 1 wherein the sidewall includes first, second, third and fourth sidewall connected portions, each of the sidewall connected portions having an inner surface, wherein the inner surface of the first portion abuts the inner surface of the third portion, and the inner surface of the second portion abuts the inner surface of the fourth portion.

4. The graphic display stand of claim 3 including at least one first fold channel between the first and third sidewall connected portions, and at least one second fold channel between the second and fourth portions, the first and third sidewall connected portions folded together about the at least one first fold channel and the second and fourth portions folded together about the at least one second fold channel.

5. The graphic display stand of claim 4 wherein the at least one first fold channel and the at least one second fold channel each include a pair of spaced apart, parallel, V-shaped channels enabling the first, second, third and fourth portions, respectively to be folded onto each other with their respective inner surfaces flush against one another.

6. The graphic display stand of claim 5 wherein portions of the spring channel are formed in the inner surfaces of each of the first, second, third and fourth sidewall connected portions, the spring channel portions in the first and third sidewall connected portions cooperating to receive a first spring wing, the spring channel portions in the second and fourth sidewall connected portions cooperating to receive a second spring wing.

7. The graphic display stand of claim 6 wherein the first, second, third and fourth sidewall connected portions are each triangular shaped structural foam elements, the first and third portions being coterminous when folded together with inner surfaces abutting, the second and fourth portions being coterminous when folded together with inner surfaces abutting.

8. A graphic display stand for supporting a display panel in an upright position, comprising:

a ground engaging bottom surface;

a sidewall extending upwardly from the ground engaging surface, the sidewall including a front surface, a rear surface opposite the front surface, and a thickness defined between the front and rear surfaces, the front surface of the sidewall defining a central channel extending perpendicular to the ground engaging surface, the central channel having a first lateral side and a second lateral side; and a channel retention element positioned within the central channel, the central channel and channel retention element cooperating to receive and retain a display panel to hold the display panel in an upright position;

wherein the channel retention element includes at least one adhesive disposed in the central channel for engaging the display panel and retaining the display panel in the central channel.

9. A graphic display stand system, comprising:

at least one structural base having first, second, third and fourth triangular sections, each section connected to at least one other section, each section having an inner surface, at least one first V-shaped fold channel between the first and third sections, at least one second V-shaped fold channel between the second and fourth sections, a square central channel between the first and second sections, the third section folded about the at least one first V-shaped fold channel such that the inner surfaces of the first and third sections abut, the fourth section folded about the at least one second V-shaped fold channel such that the inner surfaces of the second and fourth sections abut, the first, second, third and fourth sections collectively forming a ground engaging surface, the central channel extending perpendicular to the ground engaging surface;

an adhesive disposed between the inner surfaces of the first and third sections, and between the inner surfaces of the second and fourth sections;

a channel retention element positioned within the central channel; and a graphic display panel held in an upright position by the at least one structural base, the graphic display panel having a lateral edge, a front surface and a rear surface, and defining a thickness between the front and rear surfaces, the lateral edge positioned within the central channel of the base, the channel retention element engaging the graphic display panel to retain the graphic display panel within the central channel.

10. The graphic display stand system of claim 9 wherein the channel retention element includes a first portion acting on the front surface of the graphic display panel and a second portion acting on the rear surface of the graphic display panel.

11. The graphic display stand system of claim 10 wherein the first portion of the channel retention element includes a first strip of adhesive acting between the central channel and the front surface of the display panel and the second portion of the channel retention element includes a second strip of adhesive acting between the central channel and the rear surface of the display panel.

12. The graphic display stand system of claim 10 wherein the first portion of the channel retention element is positioned within the central channel between the second section and the display panel and wherein the second portion of the channel retention element is positioned within the central channel between the fourth section and the display panel.

13. The graphic display stand system of claim 10 wherein the at least one first V-shaped channel and the at least one second V-shaped channel each include a pair of spaced apart, parallel V-shaped channels.

14. The graphic display stand system of claim 13 wherein the graphic display panel includes opposing lateral edges, and wherein the system includes a first one of the structural base and a second one of the structural base, wherein the first lateral edge is positioned within the central channel of the first base and the opposite lateral edge is positioned within the central channel of the second base.

15. A method for assembling a graphic display stand system, comprising:

providing a structural base having first, second, third and fourth triangular sections, each section connected to at least one other section, each section having an inner surface, at least one first V-shaped fold channel between the first and third sections, at least one second V-shaped fold channel between the second and fourth sections, a square central channel between the first and second sections;

attaching a channel retention element into the central channel;

applying an adhesive to at least one of the first and third inner surfaces, and to at least one of the second and fourth inner surfaces;

folding the third section about the at least one first V-shaped fold channel such that the inner surfaces of the first and third sections abut;

folding the fourth section about the at least one second V-shaped fold channel such that the inner surfaces of the second and fourth sections abut, the first, second, third and fourth sections collectively forming a ground engaging surface, the central channel extending perpendicular to the ground engaging surface;

positioning the ground engaging surface on the ground;

providing a graphic display panel having opposing lateral edges, a front surface and a rear surface;

inserting one of the lateral edges into the central channel of the base, the channel retention element providing a force on the graphic display panel to retain the graphic display panel in the central channel.

16. The method of claim 15 wherein providing the channel retention element includes applying a first strip of adhesive to a first surface within the central channel, and applying a second strip of adhesive to a second surface within the central channel.

17. The method of claim 16 wherein the first strip is applied to the first and third sections of the base after the folding the third section about the at least one first V-shaped fold channel, and wherein the second strip is applied to the second and fourth sections of the base after folding the fourth section about the at least one second V-shaped fold channel.

18. The method of claim 17 including providing a second said structural base and inserting another one of the lateral edges of the graphic display panel into the central channel of the second base.

19. The method of claim 18, wherein the at least one first V-shaped fold channel and the at least one second V-shaped fold channel each include two parallel V-shaped fold channels, and wherein the step of folding the third section about the at least one first V-shaped fold channel includes folding about both first V-shaped fold channels and the step of folding the fourth section about the at least one second V-shaped fold channel includes folding about both second V-shaped fold channels.

* * * * *